US006975214B2

(12) United States Patent
Schleicher

(10) Patent No.: US 6,975,214 B2
(45) Date of Patent: Dec. 13, 2005

(54) SUPPLY UNIT FOR IDENTIFYING AND POWERING A LED UNIT, AND METHOD THEREFOR

(75) Inventor: Gotthard Schleicher, Palling (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 96 days.

(21) Appl. No.: 10/607,059

(22) Filed: Jun. 27, 2003

(65) Prior Publication Data

US 2004/0056774 A1 Mar. 25, 2004

(30) Foreign Application Priority Data

Jul. 4, 2002 (DE) ..... 102 30 154

(51) Int. Cl.[7] ..... B60Q 1/00

(52) U.S. Cl. ..... 340/435; 340/815.45; 324/605; 315/291

(58) Field of Search ..... 340/815.45, 693.1, 340/458, 333, 907, 908, 931, 286.02; 324/414, 324/403, 600, 602, 605, 606; 307/18–20, 307/24, 31–34; 315/291, 307, 82

(56) References Cited

U.S. PATENT DOCUMENTS 4,011,482 A * 3/1977 Seib ..... 315/361
5,479,159 A * 12/1995 Kelly et al. ..... 340/10.1
5,489,809 A * 2/1996 Kaya et al. ..... 307/126
5,592,051 A * 1/1997 Korkala ..... 315/210
6,051,935 A * 4/2000 Bucks et al. ..... 315/224
6,127,784 A * 10/2000 Grossman et al. ..... 315/159
6,236,170 B1 * 5/2001 de Leijer ..... 315/316
6,333,605 B1 * 12/2001 Grouev et al. ..... 315/291
6,717,660 B1 * 4/2004 Bernardo ..... 356/121

FOREIGN PATENT DOCUMENTS

| | | |
|---|---|---|
| DE | 101 39 402 A1 | 3/2003 |
| DE | 102 04 059 A1 | 8/2003 |
| EP | 0 413 991 A1 | 2/1991 |
| GB | 2 284 952 A | 6/1995 |

OTHER PUBLICATIONS

European Patent Office Search Report (referencing the 4 foreign patent documents listed above) dated Oct. 23, 2003.

* cited by examiner

*Primary Examiner*—Jeffery Hofsass
*Assistant Examiner*—Eric Blount

(57) ABSTRACT

The invention relates to a supply unit (1) and method for detecting the identity of and for supplying power to LED units (2). The supply unit (1) firstly determines, by means of a detection unit (7), the identity of a connected LED unit (2) by the application of an electrical quantity and reception of a further electrical quantity generated in response thereto by an identification unit (3). By means of a control unit (6), the power supply required for the LED unit (2) can subsequently be determined using the identity determined and said power supply can be output to the LED unit (2) via an output unit (5). In this case, both the detection of the identity and the power supply are effected via the supply terminals (4*a*, 4*b*).

3 Claims, 1 Drawing Sheet

SUPPLY UNIT FOR IDENTIFYING AND POWERING A LED UNIT, AND METHOD THEREFOR

TECHNICAL FIELD

The invention relates to a supply unit for LED units, and to a method for detecting the identity of LED units, in particular for detecting parameters necessary for supplying power to the LED unit, and to a corresponding LED unit.

BACKGROUND ART

In contrast to conventional electrical ballasts, supply units of LED units work with different loads. The term LED (light emitting device) hereinafter also encompasses so-called OLEDs (organic light emitting device). Generally, such supply units supply only one output voltage for supplying power to a connected LED unit. If a plurality of LED units or different LED units are intended to be supplied with power by the supply unit, then the supply unit has to be designed for supplying power to a plurality of LED units or different LED units and acquire the information necessary for the power supply by way of rated parameters of the LED units to be supplied.

DISCLOSURE OF THE INVENTION

Therefore, it is an object of the present invention to provide a supply unit, an LED unit and a method for detecting LED units which is improved with regard to the supply of different LED units by a supply unit.

According to the invention, this object is achieved by means of a supply unit for at least one LED unit. The supply unit has a detection unit, which is designed for detecting the identity of the LED unit by means of electrical quantities, and also supply terminals for the supply of power to the LED unit by the supply unit. According to the invention, the identity of the LED unit is detected via the supply terminals. In supply units according to the prior art, in addition to the supply lines for supplying power to the LEDs, further lines are necessary in order to obtain information about the identity of the LEDs. In practice, this leads to a considerable installation outlay. With the construction according to the invention, the supply terminals used for power supply purposes can simultaneously be used to detect the identity of connected LED units and, for example, to determine what power supply is necessary for the LEDs. Thus, the supply unit can be kept more compact and simpler, so that the required installation outlay is significantly reduced.

According to an advantageous embodiment, the supply unit furthermore contains a control unit, which controls the power supply of the LED unit on the basis of the detected identity of the LED unit. This makes it possible for the detected identity of the connected LED units to be evaluated and correspondingly controlled, so that the supply unit automatically always provides the correct power supply if, for example, a new or additional LED unit with, if appropriate, a different rated load is connected to the supply unit. If appropriate, the control unit can also prevent the power supply and output a feedback message about the state of the connected LED unit, for example if the latter is defective or incompatible with the supply unit. The detection and the power supply are preferably effected exclusively via two supply terminals.

The method according to the invention for detecting the identity of at least one LED unit has the following steps:

provision of a first electrical quantity for the LED unit to be detected, detection of the identity of the LED unit using a second electrical quantity, which is provided by the LED unit in response to the first electrical quantity. The identity is detected via supply terminals serving for supplying power to the LED unit.

According to an advantageous variant, the method furthermore comprises the control of the power supply of the LED unit on the basis of the detected identity of the LED unit. As a result of this, not only is it possible for the identity of a connected LED unit to be detected, but the information about the detected identity can be processed and the power supply can be controlled correspondingly.

In a supplementary manner, the method can be performed repeatedly during the operation of the LED unit. As a result of this, when the LED unit is changed during operation, the necessary power supply can be checked and, if appropriate, adapted. Preferably, the detection and the power supply of the LED unit are effected exclusively via two supply terminals. In order to detect the identity of the at least one LED unit, a voltage that is small in relation to the power supply is preferably applied as first electrical quantity, and the LED unit is detected by means of an impedance of an identification unit as second electrical quantity. In this case the impedance of the identification unit is small with respect to the LED impedance that is effective at the small voltage applied. The consequence of this is that the supply unit "sees" from the LED unit essentially only the identification unit and only evaluates the second electrical quantity provided by the identification unit, without an influence of LEDs connected downstream significantly influencing the second electrical quantity fed back. In the simplest case, the impedance may be a nonreactive resistance. However, active components which inherently generate an electrical quantity are also possible. Digital components may likewise be used for the abovementioned purpose. The identification unit is preferably a device which is separate from the LEDs and which may, for example, be connected upstream of the LEDs in the LED unit.

The LED unit according to the invention for connection to the abovementioned supply unit has at least one LED, supply terminals for the power supply of the supply unit, and an identification unit with technical properties that can be registered during the detection of the identity of the LED unit. In this case, the identification unit can be identified via the supply terminals.

Preferably, the detection and power supply may be effected exclusively via two supply terminals via which the LED unit is connected to the supply unit.

The identification unit may be able to be switched off. This is advantageous since it is not required during the actual power supply and an unnecessary power consumption is thus avoided. The impedance of the identification unit is preferably small with respect to the LED impedance that is effective at a voltage that is applied to the LED unit and is small in relation to the power supply.

The regulation of the voltage has been discussed above in connection with the power supply and the electrical quantities. Of course, the regulation of the output current of the supply unit is also possible here.

BEST MODE FOR CARRYING OUT THE INVENTION

Figure 1:
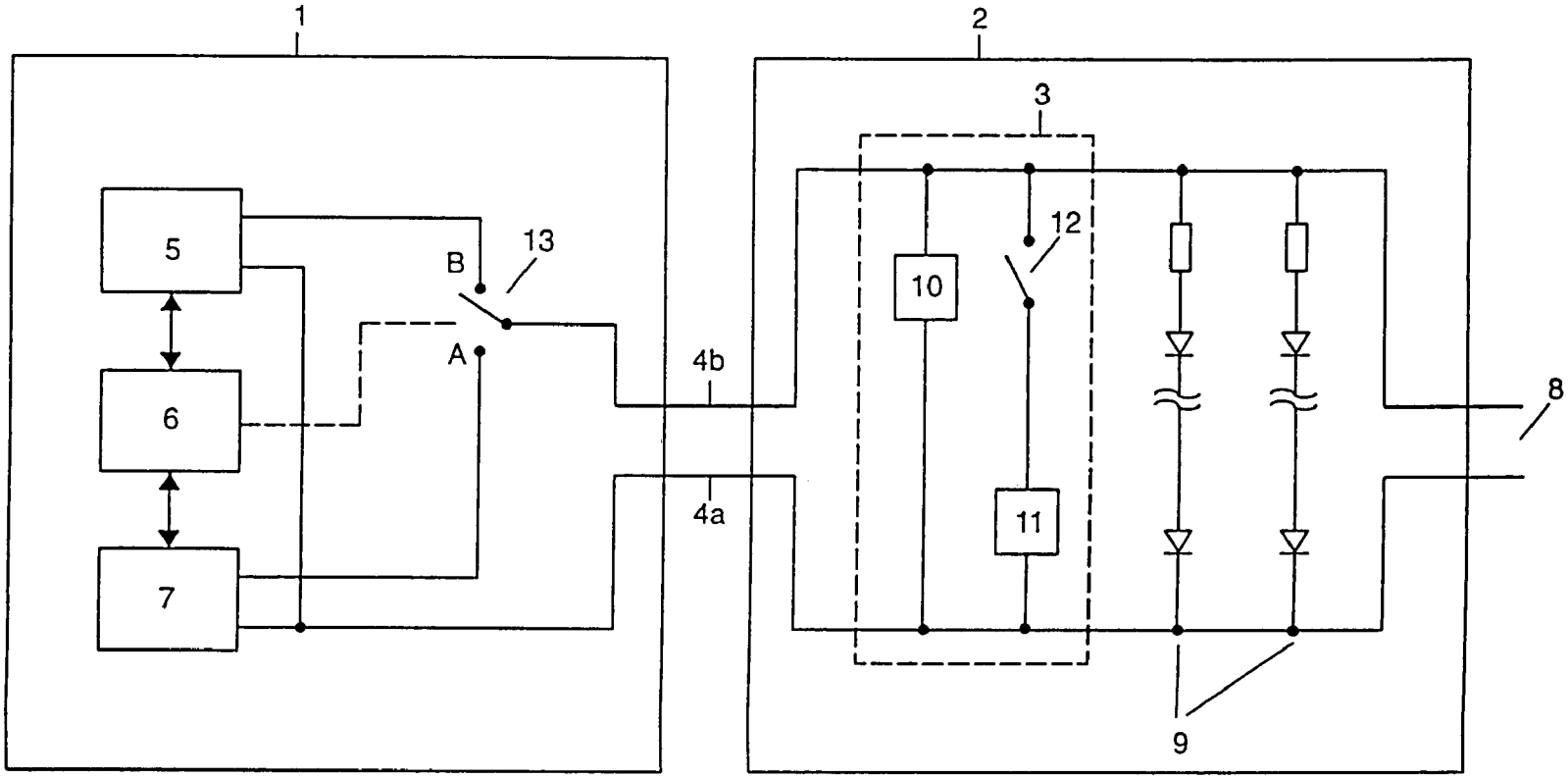
FIG. 1 shows an embodiment of the invention as a circuit diagram.

The invention is explained in more detail below with reference to the figure, which shows an embodiment of the invention as a circuit diagram.

The figure shows a system comprising a supply unit 1 and an LED unit 2, which are connected to one another via the supply lines 4*a*, 4*b*. The LED unit 2 may optionally be provided with further terminals 8 for the connection of further LED units 2 which may then likewise obtain the required power supply through the supply unit 1.

The supply unit 1 contains a detection unit 7, by means of which the supply unit 1 can detect information about the connected LED units 2, for example the supply voltage required for the power supply by the supply unit 1 for the operation of the LED unit 2, or the like. For the provision of such information, in addition to the LEDs 9, an identification unit 3 is provided in the LED unit 2 according to the invention. The identification unit 3 supplies information about the identity of the corresponding LED unit 2 back to the detection unit 7 in the supply unit 1. This is done by the detection unit 7 firstly outputting, via the supply lines 4*a*, 4*b*, an electrical quantity (generally a voltage that is small with respect to the supply voltage for the connected LEDs) to the LED unit 2 (position A of switch 13). In the case of a voltage signal, the identification unit 3 may merely comprise an impedance characteristic of the LED unit, a nonreactive resistance. Said impedance is preferably small with respect to the impedance of the LEDs 9 that is effective at a small voltage, so that, for instance at an applied voltage, a current only flows through the identification unit 3 and the detection unit 7 therefore does not "see" the LEDs 9 and, consequently, the identification unit 3 exclusively effects a feedback message to the detection unit 7.

By way of example, if a small voltage is applied to the LED unit 2 by the detection unit 7 in the supply unit 1 (switch position A), then a current flows through the identification unit 3, in particular the resistance 11, via the terminals 4*a*, 4*b* back to the detection unit 7 and is measured, and the resistance 11 in the identification unit 3 can thus be determined. Instead of a resistance, the identification unit may also contain other electrical or electronic (including active) components which are suitable for outputting a signal characteristic of the identification unit 3 of the corresponding LED unit 2 in response to an electrical quantity provided by the detection unit 7 via the supply terminals 4*a*, 4*b*.

Depending on the electrical quantity (e.g. current) fed back by the identification unit 3, the detection unit 7 can now determine the power supply (supply voltage) required for the connected LED unit 2. By means of an optional control unit 6 the information about the power supply can subsequently be forwarded to an output unit 5 provided in the supply unit 1, which output unit, by way of example, generates and outputs the required supply voltage for the LED unit(s) 2. For this purpose, the control unit 6 changes over into the switch state B, and the power supply of the LED unit(s) 2 generated by the output unit 5 is effected via the supply terminals 4*a*, 4*b*.

Since the identification unit 3 also constitutes a power consumer, it can optionally be switched off, for instance via a switch 12 triggered by a control element 10, when the power supply begins. This may be done for example by the control element 10 detecting a supply voltage output by the supply unit 1 and thereupon changing the switch 12 over into the open state, so that a supply current flows only through the LEDs 9.

During the power supply, it is possible to effect a changeover into the detection mode (switch position A), for instance in order to check whether an LED unit 2 is defective or has been exchanged. As a result, the supply parameters can be determined anew during operation and be correspondingly adapted in the output mode (switch position 2).

By means of the construction according to the invention, both the supply of the LED units 2 and the detection of the identity, i.e. of the supply parameters of the LED units 2 can be effected exclusively via the supply terminals 4*a*and 4*b*. Further lines or terminals are not necessary, thus avoiding the use of complicated and complex circuits for the LED supply.

What is claimed is:

1. A method for detecting an identity of at least one LED unit that is powered from a power supply via supply terminals, the method comprising the steps of:

providing, from the power supply, a first electrical quantity to the LED unit; and detecting the identity of the LED unit using a second electrical quantity, wherein the second electrical quantity is provided by the LED unit in response to the first electrical quantity;

wherein:

(i) the identity of the LED unit is detected via the supply terminals;

(ii) in order to detect the identity of the LED unit, a voltage that is substantially less than that of the power supply is applied to the LED unit; and (iii) the identity of the LED unit is detected by an impedance of an identification unit, the impedance of the identification unit being substantially less than an impedance of the LED unit that is effective at the voltage applied to the LED unit.

2. The method of claim 1, further comprising the step of controlling the power supplied to the LED unit on the basis of the detected identity of the LED unit.

3. The method of claim 1, wherein the steps of providing and detecting are performed repeatedly during operation of the LED unit.

* * * * *